US008243415B2

(12) United States Patent
Sakakura

(10) Patent No.: US 8,243,415 B2
(45) Date of Patent: Aug. 14, 2012

(54) IGNITION PLUG AND IGNITION SYSTEM

(75) Inventor: Yasushi Sakakura, Ichinomiya Aichi (JP)

(73) Assignee: NGK Spark Plug Co., Ltd. (JP)

( * ) Notice: Subject to any disclaimer, the term of this patent is extended or adjusted under 35 U.S.C. 154(b) by 268 days.

(21) Appl. No.: 12/644,374

(22) Filed: Dec. 22, 2009

(65) Prior Publication Data

US 2010/0165539 A1 Jul. 1, 2010

(30) Foreign Application Priority Data

Dec. 26, 2008 (JP) ..... 2008-332805

(51) Int. Cl.
*F23Q 3/00* (2006.01)

(52) U.S. Cl. ..... 361/247; 361/253

(58) Field of Classification Search ..... 361/247, 361/253; 313/118, 134
See application file for complete search history.

(56) References Cited

U.S. PATENT DOCUMENTS 3,883,762 A * 5/1975 Harris et al. ..... 313/130
4,337,408 A 6/1982 Sone et al. ..... 313/130
4,951,173 A * 8/1990 Suzuki et al. ..... 361/253
2007/0221156 A1* 9/2007 Hagiwara et al. ..... 123/143 B

FOREIGN PATENT DOCUMENTS

| | | |
|---|---|---|
| GB | 2 147 361 | 5/1985 |
| JP | 54-55010 | 4/1979 |
| JP | 3214582 | 9/1991 |
| JP | 2007287665 | 11/2007 |
| JP | 2008045449 | 2/2008 |

OTHER PUBLICATIONS

European Search Report dated Mar. 24 2010, from corresponding European Patent Application No. 09180742.0-1231, 5 pages.
Japanese Office Action, dispatched May 15, 2012, issued in corresponding Japanese Patent Application No. 2009-2859747 (including English translation), 9 pages.

* cited by examiner

*Primary Examiner* — Danny Nguyen
(74) *Attorney, Agent, or Firm* — Kusner & Jaffe

(57) ABSTRACT

An ignition plug having a center electrode, an insulator holding the center electrode in an axial bore, and a ground electrode disposed in contact with a front end portion of the insulator and having a through-hole whose center coincides with the axis of the center electrode. A semiconductor layer in contact with the center electrode and the ground electrode is formed in a portion of the surface of the insulator.

10 Claims, 11 Drawing Sheets

FIG. 7

| | INTER-ELECTRODE RESISTANCE (Ω) | PERCENTAGE OF IGNITION (%) | |
|---|---|---|---|
| | | ATMOSPHERIC PRESSURE | +1 MPa |
| COMPARATIVE EXAMPLE | 1 M | 95 | 40 |
| EXAMPLE 1 | 10 | 100 | 100 |
| EXAMPLE 2 | 100 | 100 | 100 |
| EXAMPLE 3 | 1 k | 100 | 100 |
| EXAMPLE 4 | 10 k | 100 | 100 |
| EXAMPLE 5 | 100 k | 100 | 100 |
| EXAMPLE 6 | 1 M | 100 | 100 |

FIG. 8

| | INTER-ELECTRODE RESISTANCE (Ω) | OCCURRENCE OF DISCHARGE AT DIFFERENT VOLTAGE RISING RATES | | | |
|---|---|---|---|---|---|
| | | 0.01 (*) | 0.1 (*) | 1 (*) | 10 (*) |
| EXAMPLE 1 | 10 | NO | NO | YES | YES |
| EXAMPLE 2 | 100 | NO | NO | YES | YES |
| EXAMPLE 3 | 1 k | NO | NO | YES | YES |
| EXAMPLE 4 | 10 k | NO | NO | YES | YES |
| EXAMPLE 5 | 100 k | NO | NO | YES | YES |
| EXAMPLE 6 | 1 M | NO | NO | YES | YES |

* $\times 10^{10}$ (V/S)

IGNITION PLUG AND IGNITION SYSTEM

FIELD OF THE INVENTION

The present invention relates to an ignition plug and an ignition system for igniting fuel by use of the ignition plug.

BACKGROUND OF THE INVENTION

Conventional ignition plugs for igniting fuel (air-fuel mixture) by means of plasma include plasma jet ignition plugs as disclosed in Japanese Patent Application Laid-Open (kokai) No. 2007-287665 and Japanese Patent Application Laid-Open (kokai) No. 2008-45449, and igniter plugs as disclosed in Japanese Patent Application Laid-Open (kokai) No. 3-214582.

For example, a plasma jet ignition plug has, at its front end portion, a cylindrical cavity surrounded by a center electrode and an insulator. When a spark discharge of high energy occurs between the center electrode and a ground electrode, the interior of the cavity instantaneously acquires an intense heat state. Then, an air-fuel mixture present in the cavity is ionized and, at the same time, rapidly expands, thereby jetting out from the cavity in the form of a flame-like plasma. Since such a flame-like plasma extends into a cylinder, the area of contact with the air-fuel mixture increases. Thus, the plasma jet ignition plug is characterized by superiority in ignition performance over an ordinary spark plug which ignites fuel by means of sparks.

However, a conventional plasma jet ignition plug requires relatively high discharge voltage for generating a spark discharge between the center electrode and the ground electrode before jetting of plasma. This involves a problem of increase in generated electric noise and a problem of deterioration in the cavity and a through-hole (orifice) of the ground electrode caused by the occurrence of channeling.

In order to solve these problems, for example, the igniter plug described in the aforementioned Japanese Patent Application No. 3-214582 employs a solid-type semiconductor chip disposed between the center electrode and the ground electrode so as to lower discharge voltage. However, such a structure may involve the occurrence of misfire caused by discharge between the center electrode and a metallic shell stemming from the flow of current in the vicinity of the interface between the semiconductor chip and the insulator.

The present invention overcomes the above-mentioned problems and provides an ignition plug which ignites fuel by means of plasma with low discharge voltage and exhibits high ignition performance.

SUMMARY OF THE INVENTION

The present invention has been conceived for at least partially solving the above-mentioned problems and can be implemented in the form of the following modes or application examples.

Embodiment 1. An ignition plug comprising a center electrode; an insulator having an axial bore extending in a direction of an axis of the center electrode, and holding the center electrode in the axial bore; and a ground electrode disposed in contact with a front end portion of the insulator and having a through-hole. A front end portion of the center electrode is located rearward of the front end portion of the insulator. A semiconductor layer in contact with the center electrode and the ground electrode is formed in a portion of a surface of the insulator.

In the ignition plug of Embodiment 1, the surface of the insulator has the semiconductor layer formed therein and connecting the center electrode and the ground electrode; thus, discharge voltage can be lowered. Accordingly, the generation of electric noise and channeling-induced deterioration can be restrained. The semiconductor layer formed in the surface of the insulator accelerates discharge therealong, thereby restraining the occurrence of discharge between the center electrode and the metallic shell. As a result, the performance in igniting fuel can be enhanced. The ignition plug allows the formation of a cavity (recess) where plasma is generated, in a region defined by the center electrode and the axial bore.

Embodiment 2. An ignition plug according to Embodiment 1, wherein at least a portion of a surface of the ground electrode located on a side toward the insulator is in contact with the front end portion of the insulator via the semiconductor layer. The ignition plug has a structure in which the semiconductor layer intrudes into the contact surface between the insulator and the ground electrode. Thus, even when the diameter of the through-hole of the ground electrode increases due to deterioration, the semiconductor layer reliably connects the center electrode and the ground electrode.

Embodiment 3. An ignition plug according to Embodiment 2, wherein the portion of the ground electrode which is in contact with the front end portion of the insulator via the semiconductor layer extends at least 0.1 mm radially outward from a circumference of the through-hole. The ignition plug can exhibit sufficiently ensured connection between the semiconductor layer and the ground electrode even when the diameter of the through-hole of the ground electrode increases due to deterioration.

Embodiment 4. An ignition plug according to any one of Embodiments 1 to 3, wherein the semiconductor layer lowers in electric conductivity from a surface of the semiconductor layer toward an interior of the insulator. The ignition plug can exhibit the enhanced probability of discharge along the surface of the semiconductor layer.

Embodiment 5. An ignition plug according to any one of Embodiments 1 to 4, wherein an inter-electrode resistance between the center electrode and the ground electrode is $1\times10^{1}\Omega$ to $1\times10^{6}\Omega$ inclusive. The ignition plug can exhibit the enhanced probability of discharge between the center electrode and the ground electrode.

Embodiment 6. An ignition plug according to any one of Embodiments 1 to 5, wherein the semiconductor layer is formed through dispersion of a semiconductor in a portion of the surface of the insulator. This configuration enables relatively easy formation of the semiconductor layer.

Embodiment 7. An ignition plug according to any one of Embodiments 1 to 6, wherein the semiconductor layer is formed by means of sintering a semiconductor a plurality of times into a portion of the surface of the insulator. This configuration enables relatively easy formation of the semiconductor layer.

Embodiment 8. An ignition plug according to any one of Embodiments 1 to 7, wherein the semiconductor layer contains an oxide semiconductor. Examples of the oxide semiconductor include copper oxide and iron oxide. In place of the oxide semiconductor, a Group IV semiconductor, such as silicon, can also be used.

Embodiment 9. An ignition plug according to any one of Embodiments 1 to 8 can have a structure in which a rear end portion of the semiconductor layer is in contact with a circumferential portion of a front end surface of the center electrode.

Embodiment 10. An ignition plug according to any one of Embodiments 1 to 9, wherein a diameter of the through-hole of the ground electrode is equal to or greater than that of the axial bore of the insulator. This configuration can enhance ignition performance, since the ground electrode does not hinder the jetting of plasma.

Embodiment 11. An ignition plug according to any one of Embodiments 1 to 10, wherein the ignition plug is a plasma jet ignition plug. The ignition plug of the present invention can also be applied to an igniter plug for use in a gas engine or a gas turbine engine, in addition to a plasma jet ignition plug for use in a gasoline engine.

Embodiment 12. An ignition system for igniting fuel, comprising an ignition plug according to any one of Embodiments 1 to 11, and an ignition device for applying a voltage whose rising rate is $1\times10^{10}$ V/sec or higher to the center electrode or the ground electrode of the ignition plug. The application of voltage to the ignition plug by means of the ignition system can reliably generate a spark discharge between the center electrode and the ground electrode even when the inter-electrode resistance drops due to the presence of the semiconductor layer.

BRIEF DESCRIPTION OF THE DRAWINGS

FIG. 7 is a table showing the results of an evaluation experiment on ignition performance;

FIG. 8 is a table showing the results of a discharge experiment at different voltage rising rates;

DETAILED DESCRIPTION OF PREFERRED EMBODIMENT

Figure 1:
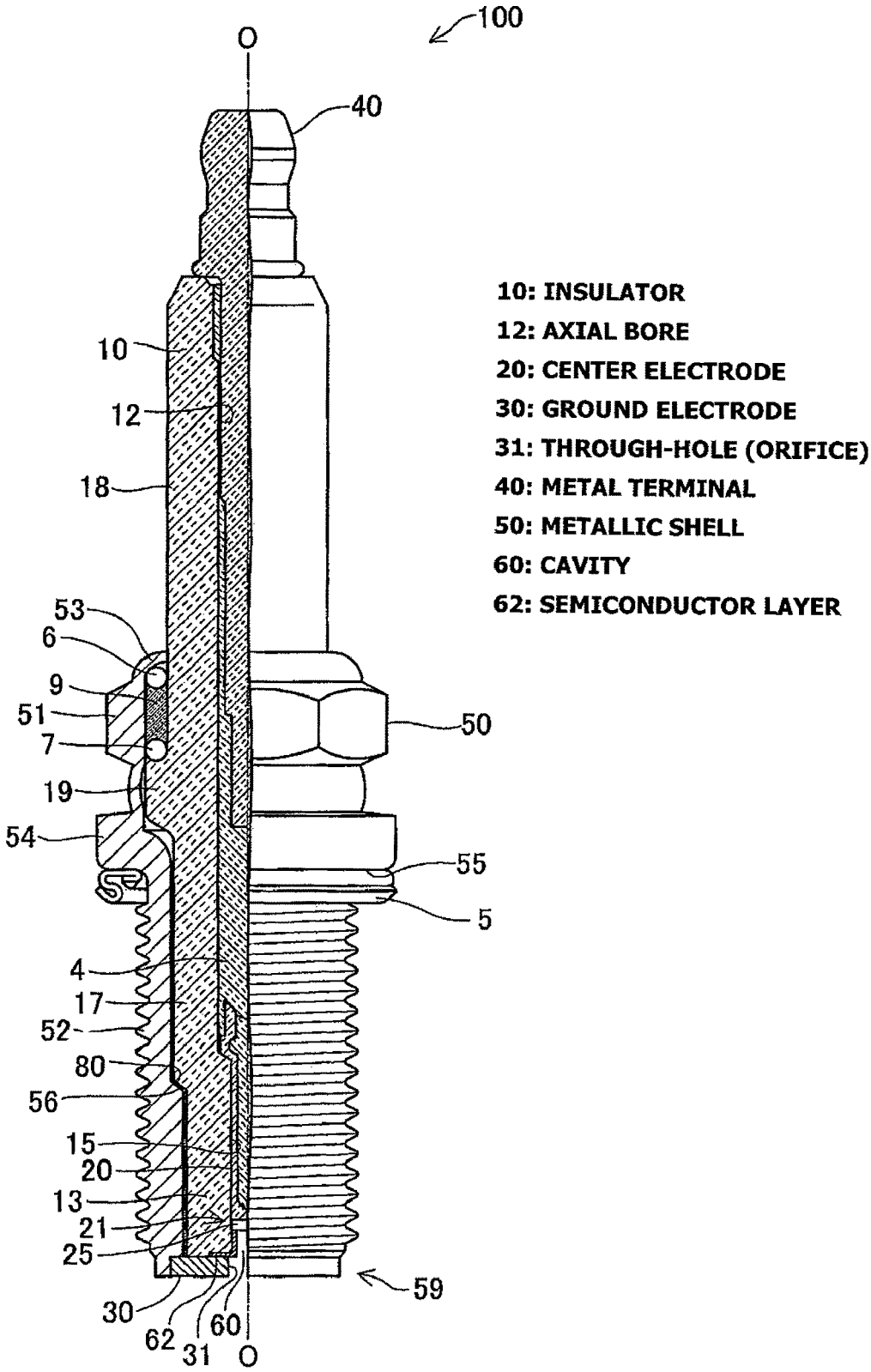
FIG. 1 is a partially sectioned view showing the structure of a plasma jet ignition plug 100 according to an embodiment of the present invention.

Referring now to the drawings wherein the showings are for the purpose of illustrating a preferred embodiment of the invention only and not for the purpose of limiting same, an embodiment of the present invention will next be described in the following sequence with reference to the drawings:

A. Structure of plasma jet ignition plug

B. Schematic configuration of ignition system

C. Examples

A. Structure of Plasma Jet Ignition Plug

Figure 2:
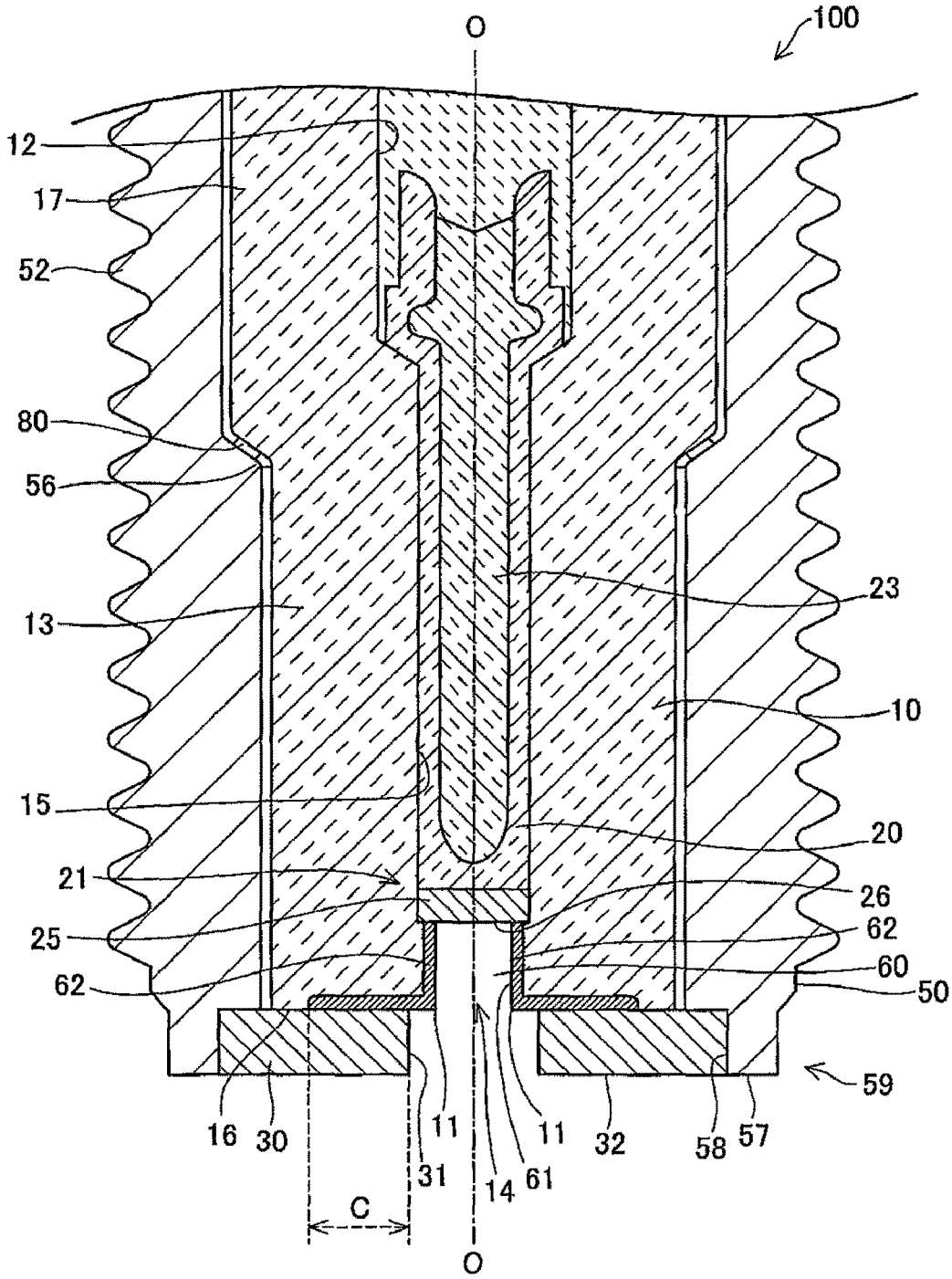
FIG. 2 is a sectional view showing, on an enlarged scale, a front end portion of the plasma jet ignition plug 100.

FIG. 1 is a partially sectioned view showing the structure of a plasma jet ignition plug 100 according to an embodiment of the present invention. FIG. 2 is a sectional view showing, on an enlarged scale, a front end portion of the plasma jet ignition plug 100. In the following description, the direction of an axis O of the plasma jet ignition plug 100 in FIGS. 1 and 2 is referred to as the vertical direction, and the lower side of the plasma jet ignition plug 100 in FIGS. 1 and 2 is referred to as the front side of the plasma jet ignition plug 100, and the upper side as the rear side of the plasma jet ignition plug 100.

As shown in FIG. 1, the plasma jet ignition plug 100 includes an insulator 10; a metallic shell 50 which holds the insulator 10; a center electrode 20 which is held in the insulator 10 along the direction of the axis O; a ground electrode 30 welded to a front end portion 59 of the metallic shell 50; and a metal terminal 40 provided at a rear end portion of the insulator 10.

The insulator 10 is formed through firing of alumina or the like and is a tubular, electrically insulative member having an axial bore 12 extending in the direction of the axis O. The insulator 10 has a flange portion 19 formed substantially at the center with respect to the direction of the axis O. The flange portion 19 has a large outside diameter. A rear trunk portion 18 is located rearward of the flange portion 19. The insulator 10 has a front trunk portion 17 located frontward of the flange portion 19. The front trunk portion 17 has an outside diameter that is smaller than that of the rear trunk portion 18. A leg portion 13 is located frontward of the front trunk portion 17 and has an outside diameter that is smaller than that of the front trunk portion 17. A portion between the leg portion 13 and the front trunk portion 17 is formed in a stepped manner.

As shown in FIG. 1, a portion of the axial bore corresponding to the leg portion 13 serves as an electrode-accommodation portion 15 and is reduced in diameter as compared with a portion of the axial bore 12 corresponding to the front trunk portion 17, the flange portion 19, and the rear trunk portion 18. The axial bore 12 is further reduced in diameter at a portion located frontward of the electrode accommodation portion 15, and the portion serves as a front-end small-diameter portion 61. The circumferential wall of the front-end small-diameter portion 61 continues to a front end surface 16 of the insulator 10, thereby forming an opening portion 14 of the axial bore 12.

The center electrode 20 is a cylindrical, columnar electrode rod formed from an Ni alloy, such as INCONEL (trademark) 600 or 601, or the like, and internally has a metal core 23 formed from copper or the like having excellent thermal conductivity. The center electrode 20 has a disklike electrode chip 25 welded at its front end portion 21. The electrode chip 25 is formed from an alloy which predominantly contains a noble metal or tungsten. In the present embodiment, the entirety of the center electrode 20 and the electrode chip 25 welded to the center electrode 20 is referred to as "center electrode."

A rear end portion of the center electrode 20 is expanded in diameter to assume the form of a flange. The flange-like portion in the axial bore 12 is in contact with a step-like region from which the electrode accommodation portion 15 starts, whereby the center electrode 20 is positioned within the electrode accommodation portion 15. The circumferential edge of a front end surface 26 of the front end portion 21 of the center electrode 20 (more specifically, a front end surface 26 of the electrode chip 25 joined to the front end portion 21 of the center electrode 20) is in contact with a stepped portion that is formed between the electrode accommodation portion 15 and the front-end small-diameter portion 61, which differ in diameter. By virtue of this configuration, there is formed a discharge space of small volume that is defined by the circumferential surface of the front-end small-diameter portion 61 of the axial bore 12 and the front end surface 26 of the center electrode 20. The discharge space is referred to as a cavity 60. A spark discharge generated in a spark discharge gap between the ground electrode 30 and the center electrode 20 passes through the space within the cavity 60 and along the wall surface of the cavity 60. Energy applied after dielectric breakdown effected by the spark discharge forms plasma within the cavity 60. The plasma jets out from an opening end 11 of the opening portion 14.

As shown in FIG. 1, the center electrode 20 is electrically connected to a metal terminal 40 located on the rear side via an electrically conductive seal body 4 that is provided within the axial bore 12 and that is formed from a mixture of metal and glass. The seal body 4 functions to fix the center electrode 20 and the metal terminal 40 within the axial bore 12 and establishes electrical conduction between the center electrode 20 and the metal terminal 40. A high-voltage cable (not shown) is connected to the metal terminal 40 via a plug cap (not shown). An ignition device 320 shown in FIG. 4 applies power to the metal terminal 40 via the high-voltage cable.

A metallic shell 50 is a cylindrical metal member for fixing the plasma jet ignition plug 100 to the engine head of an internal combustion engine 300. Metallic shell 50 also holds the insulator 10 in a surrounding manner. The metallic shell 50 is formed from an iron-based material and includes a tool engagement portion 51 that is dimensioned to engage with an un-illustrated plug wrench, and a threaded portion 52 that is dimensioned to threadingly engage with the engine head provided at an upper portion of the internal combustion engine 300.

The metallic shell 50 has a crimp portion 53 located rearward of the tool engagement portion 51. Ring members 6 and 7 intervene between a portion of the metallic shell 50 extending from the tool engagement portion 51 to the crimp portion 53 and the rear trunk portion 18 of the insulator 10. A space between the ring members 6 and 7 is filled with powder of talc 9. When the crimp portion 53 is crimped, the insulator 10 is pressed frontward in the metallic shell 50 via the ring members 6 and 7 and the talc 9. Accordingly, as shown in FIG. 1, a stepped portion between the leg portion 13 and the front trunk portion 17 is supported via an annular packing 80 by an engagement portion 56 formed in a step-like manner on the inner circumferential surface of the metallic shell 50, whereby the metallic shell 50 and the insulator 10 are united together. The packing 80 maintains gas-tightness of the junction between the metallic shell 50 and the insulator 10, thereby preventing outflow of combustion gas. Also, as shown in FIG. 1, the metallic shell 50 has a flange portion 54 formed between the tool engagement portion 51 and the threaded portion 52. A gasket 5 is disposed through fitting in the vicinity of the rear end of the threaded portion 52, i.e., on a seat surface 55 of the flange portion 54.

The ground electrode 30 is provided at the front end portion 59 of the metallic shell 50. The ground electrode 30 is formed from a metal having excellent resistance to spark-induced erosion, such as by way of example and not limitation, a Ni-based alloy, such as INCONEL (trademark) 600 or 601. As shown in FIG. 1, the ground electrode 30 assumes the form of a disk having a through-hole 31 (also called "orifice 31") whose center coincides with the axis O. The ground electrode 30 is engaged with an engagement portion 58 formed on the inner circumferential surface of the front end portion 59 of the metallic shell 50, while being in contact with the front end surface 16 of the insulator 10 with its thickness direction aligned with the direction of the axis O. The ground electrode 30 is joined to the metallic shell 50 such that, while a front end surface 32 is flush with a front end surface 57 of the metallic shell 50, the outer circumferential edge of the ground electrode 30 is laser welded to the engagement portion 58 along the entire circumference thereof. The through-hole 31 of the ground electrode 30 is formed such that the minimal diameter of the through-hole 31 is equal to or greater than the diameter of the opening portion 14 (opening end 11) of the insulator 10. The interior and the exterior of the cavity 60 communicate with each other through the through-hole 31.

In the present embodiment, as shown in FIG. 2, a semiconductor layer 62 is formed along an inner surface (inner wall) of the insulator 10 which partially constitutes the cavity 60, in such a manner as to connect the front end surface 26 of the center electrode 20 and the ground electrode 30. The semiconductor layer 62 is formed through dispersion of an oxide semiconductor in a portion of the surface of the insulator 10. Specifically, the semiconductor layer 62 is formed by repeating a plurality of times (e.g., four to five times) the following process: a slurry of oxide semiconductor (e.g., iron oxide or copper oxide) is applied to the cavity wall of the insulator 10 and a portion of the front end surface 16 of the insulator 10, followed by sintering.

The semiconductor layer 62 of the present embodiment is formed such that its rear end portion is in contact with the front end surface of the center electrode 20, whereas its front end portion intrudes into the contact surface between the front end surface 16 of the insulator 10 and the ground electrode 30. Thus, a portion of the surface of the ground electrode 30 located on a side toward the insulator 10 is in contact with a front end portion of the insulator 10 via the semiconductor layer 62. By virtue of the formation of the semiconductor layer 62 at the junction between the front end surface 16 of the insulator 10 and the ground electrode 30, even when the orifice 31 gradually increases in diameter due to channeling in association with the jetting of plasma from the cavity 60, the semiconductor layer 62 can reliably connect the center electrode 20 and the ground electrode 30. According to the present embodiment, a portion of the ground electrode 30 which connects with the front end surface 16 of the insulator 10 via the semiconductor layer 62 extends at least 0.1 mm radially outward from the circumference of the through-hole 31. Hereinafter, this quantity is called "contact length C."

Figure 3:
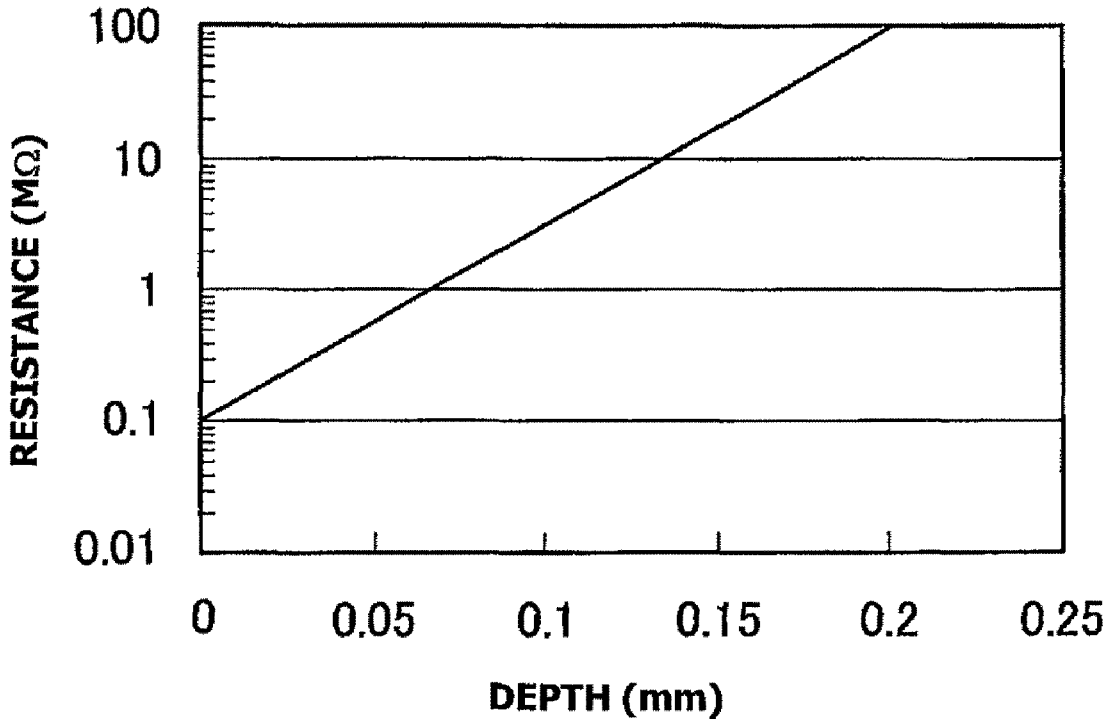
FIG. 3 is a graph showing an electrical characteristic of a semiconductor layer 62.

FIG. 3 is a graph showing an electrical characteristic of the semiconductor layer 62. The horizontal axis of the graph represents the depth from the surface of the semiconductor layer 62 toward the interior of the insulator 10 in the thickness direction of the semiconductor layer 62. The vertical axis of the graph represents the resistance of the semiconductor layer 62 at a certain depth. As shown in the graph, the semiconductor layer 62 of the present embodiment has a resistance of 0.1 MΩ in the vicinity of its surface, whereas the semiconductor layer 62 has a resistance of 100 MΩ at a depth of 0.2 mm. That is, the semiconductor layer 62 lowers in electric conductivity from the surface toward the interior of the insulator 10. The formation of the semiconductor layer 62 having such a characteristic in the wall of the cavity 60 accelerates discharge along the surface of the semiconductor layer 62 which has higher electric conductivity, thereby restraining direct discharge from the center electrode 20 to the metallic shell 50 and thus accelerating spark discharge within the cavity 60. As a result, the percentage of ignition of the plasma jet ignition plug 100 can be improved, and the deterioration of the insulator 10 can be restrained.

B. Schematic Configuration of Ignition System

Next will be described the outline of an ignition system 1 for controlling ignition to be effected by the plasma jet ignition plug 100.

Figure 4:
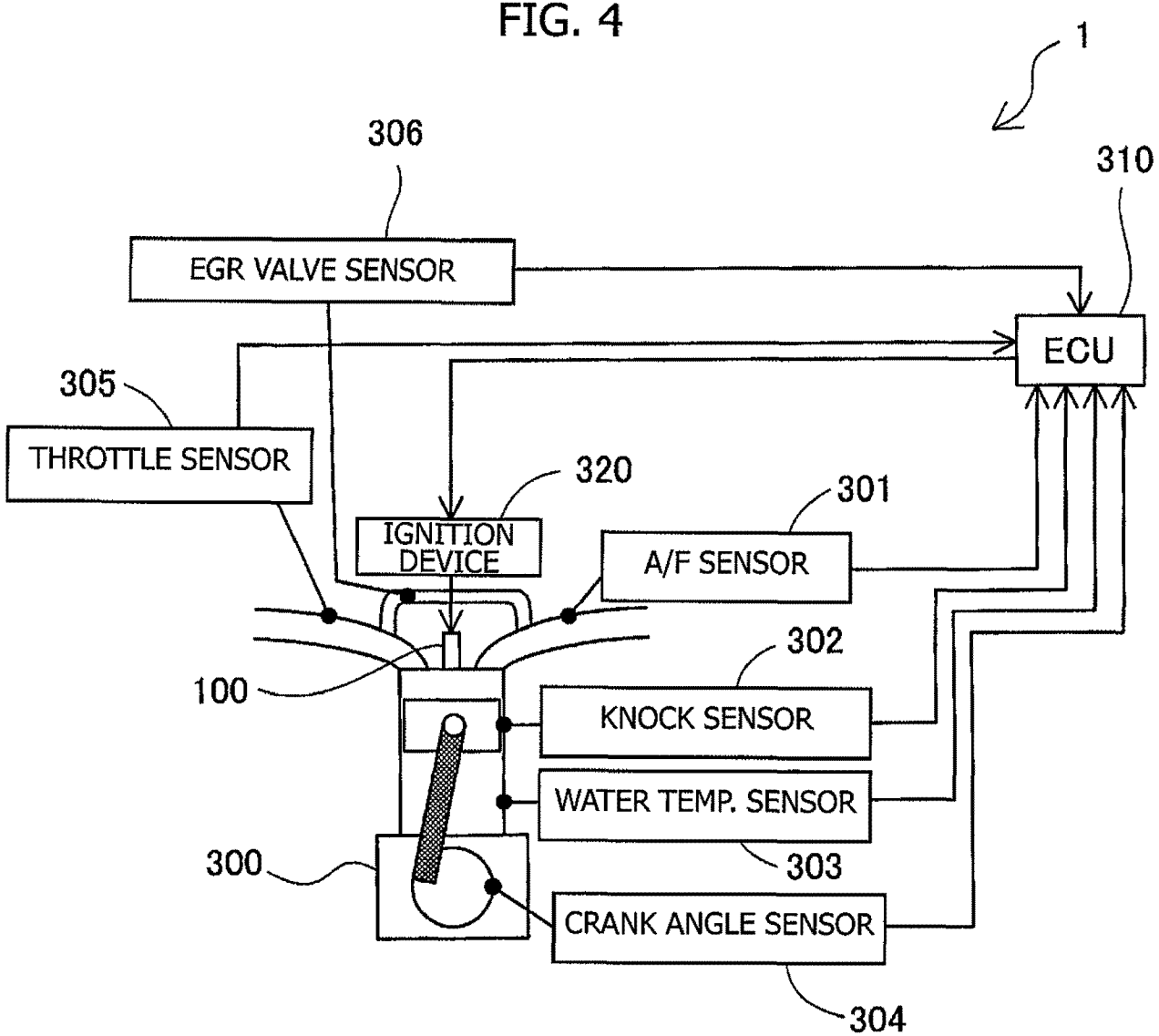
FIG. 4 is a view showing the schematic configuration of an ignition system 1.

FIG. 4 is a view showing the schematic configuration of the ignition system 1. As shown in FIG. 4, the ignition system 1 includes the internal combustion engine 300 having the plasma jet ignition plug 100; the ignition device 320 for activating ignition by the plasma jet ignition plug 100; various sensors for detecting operating conditions of the internal combustion engine 300; and an ECU (Engine Control Unit) 310 to which the sensors are connected.

Attached to the internal combustion engine 300 are an A/F sensor 301 for detecting the air-fuel ratio; a knock sensor 302 for detecting the occurrence of knocking; a water temperature sensor 303 for detecting the temperature of cooling water; a crank angle sensor 304 for detecting the crank angle; a throttle sensor 305 for detecting the opening of a throttle; and an EGR valve sensor 306 for detecting the opening of an EGR valve.

These sensors are connected to the ECU 310. The ECU 310 determines the ignition timing of the plasma jet ignition plug 100 from the operating conditions of the internal combustion engine 300 detected by these sensors. On the basis of a determined ignition timing, the ECU 310 outputs an ignition signal to the ignition device 320.

On the basis of the ignition signal received from the ECU 310, the ignition device 320 controls ignition to be effected the plasma jet ignition plug 100. Specifically, upon reception of the ignition signal from the ECU 310, the ignition device 320 applies high voltage to the plasma jet ignition plug 100 to generate spark discharge, thereby causing dielectric breakdown to occur through the spark discharge gap. Then, far higher energy is applied to the spark discharge gap at which dielectric breakdown has occurred. By this procedure, plasma is jetted out from the plasma jet ignition plug 100 and ignites an air-fuel mixture. The specific configuration of the ignition device 320 is disclosed in, for example, Japanese Patent Application Laid-Open (kokai) No. 2007-287665.

Figure 5:
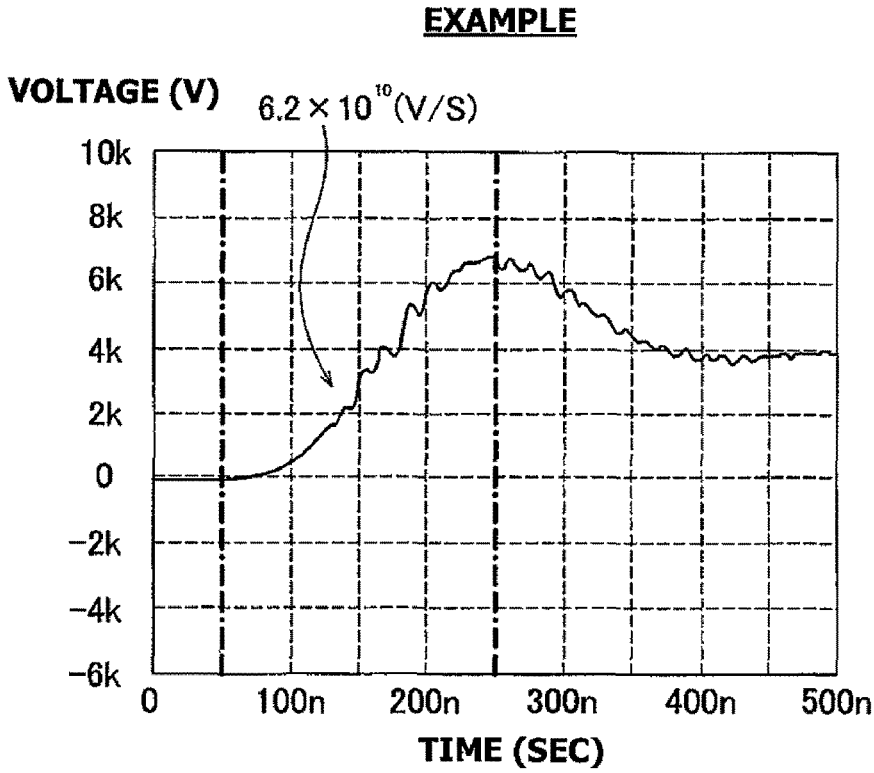
FIG. 5 is a graph showing an example waveform of voltage which an ignition device 320 applies to the plasma jet ignition plug 100 for initiation of ignition.
Figure 6:
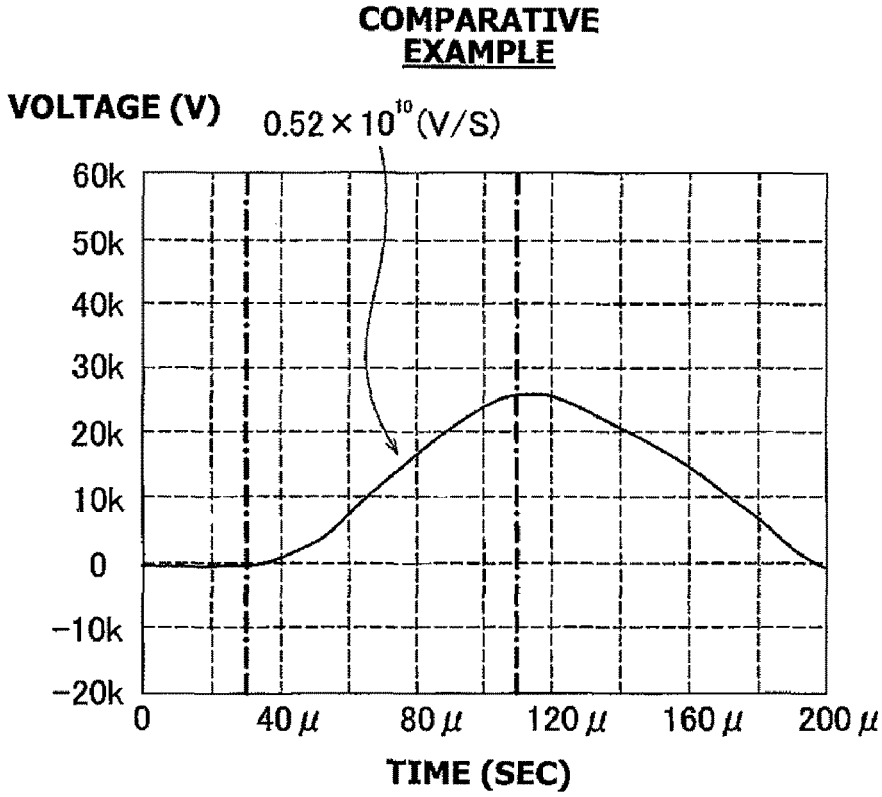
FIG. 6 is a graph showing a comparative example of voltage waveform for an ordinary ignition plug to initiate ignition.

FIG. 5 is a graph showing an example waveform of voltage which the ignition device 320 applies to the plasma jet ignition plug 100 for initiation of ignition. FIG. 6 is a graph showing a comparative example of voltage waveform for an ordinary ignition plug to initiate ignition. As shown in FIG. 6, in the ordinary ignition plug, spark discharge can be generated through application of a voltage whose rising rate is about $0.52\times10^{10}$ volts/sec (hereinafter, written as "V/S"). By contrast, as shown in FIG. 5, the ignition device 320 of the present embodiment applies a voltage whose rising rate is $6.2\times10^{10}$ V/S. That is, as compared with the conventional practice, voltage is applied at about 10-fold higher a voltage rising rate. By virtue of application of voltage at such a voltage rising rate, even when an actually applied voltage drops in association with a drop in the inter-electrode resistance between the center electrode and the ground electrode stemming from the presence of the semiconductor layer 62, voltage required for spark discharge can be sufficiently supplied.

C. Examples

In order to verify the effects of the present invention, various experiments were conducted on the plasma jet ignition plugs 100 manufactured on the basis of the above-mentioned embodiment. The results of the experiments are described below.

(C1) Evaluation Experiment on Ignition Performance

First, a plurality of plasma jet ignition plugs 100 of different inter-electrode resistances were prepared as Examples 1 to 6. These plasma jet ignition plugs 100 were subjected to an experiment for evaluation of ignition performance.

FIG. 7 shows the results of the evaluation experiment on the Examples. The plasma jet ignition plugs 100 were measured by use of a resistance meter for the resistance between the center electrode 20 and the ground electrode 30, i.e., the inter-electrode resistance (resistance on the surface of the semiconductor layer 62). The measured resistances are as follows: Example 1: 10Ω; Example 2: 100Ω; Example 3: 1 kΩ; Example 4: 10 kΩ; Example 5: 100 kΩ; and Example 6: 1 MΩ.

In the present experiment, discharge was carried out 20 times for each inter-electrode resistance in the environment of the atmospheric pressure and in the environment of +1 MPa for the individual Examples, and the percentage of successful ignition was obtained. In the present experiment, an igniter plug having a solid-type semiconductor provided between the center electrode and the ground electrode thereof was prepared as Comparative Example. This igniter plug was also subjected to the same experiment. The inter-electrode resistance of the igniter plug was 1 MΩ.

As shown in FIG. 7, in the present experiment, the igniter plug of the Comparative Example exhibited a percentage of ignition of 95% in the environment of the atmospheric pressure, but a low percentage of ignition of 40% in the environment of +1 MPa. An igniter plug having a solid-type semiconductor is known for the occurrence of discharge in such region that makes it easier for discharge to occur, when the pressure around a front end of the plug is high. Thus, in the environment having a high pressure of +1 MPa, the percentage of ignition has dropped conceivably for the following reason: discharge is not generated from the center electrode to the ground electrode, but is generated from the center electrode to the metallic shell through the interior of the semiconductor chip or along the interface between the semiconductor chip and the insulator.

By contrast, both in the environment of the atmospheric pressure and in the environment of +1 MPa, all of Examples 1 to 6 were successful in ignition at a percentage of 100%. It is believed that this success is for the following reason: because the semiconductor layers 62 of the Examples exhibit a drop in electric conductivity in a direction toward the interiors of the insulators 10, even in the environment of high pressure, discharge along the surfaces of the semiconductor layers 62, i.e., discharge within the cavities 60, is accelerated. That is, even with the disposition of the semiconductor layer 62 between the center electrode 20 and the ground electrode 30, discharge within the cavity 60 is accelerated. Furthermore, by means of formation of the semiconductor layer 62 through dispersion of a semiconductor along the inner wall of the insulator 10, the electric conductivity of the semiconductor layer 62 drops, i.e., lowers, toward the interior of the insulator 10, thereby accelerating discharge on the surface of the semiconductor layer 62. Accordingly, even in the environment of high pressure, such as within a cylinder, an air-fuel mixture can be ignited more reliably.

(C2) Experiment on Discharge at Various Voltage Rising Rates

Subsequently, the above-mentioned plasma jet ignition plugs 100 of Examples 1 to 6 were subjected to an experiment in which voltage was applied at various voltage rising rates to check to see if discharge occurs or not. In the present experiment, voltage was applied at voltage rising rates of $0.01\times10^{10}$ V/S, $0.1\times10^{10}$ V/S, $1\times10^{10}$ V/S, and $10\times10^{10}$ V/S to check to see if discharge occurs or not in the Examples.

FIG. 8 shows the results regarding existence or nonexistence of discharge at different voltage rising rates. As illustrated, at a voltage rising rate of $0.1\times10^{10}$ V/S or lower, discharge did not occur in all of the Examples. However, at a voltage rising rate of $1\times10^{10}$ V/S or higher, discharge was observed in all of the Examples. That is, in the case where the semiconductor layer 62 is disposed between the center electrode 20 and the ground electrode 30, through application of a voltage whose rising rate is at least $1\times10^{10}$ V/S, discharge can be generated between the center electrode 20 and the ground electrode 30.

(C3) Evaluation Experiment on Discharge Voltage

Figure 9:
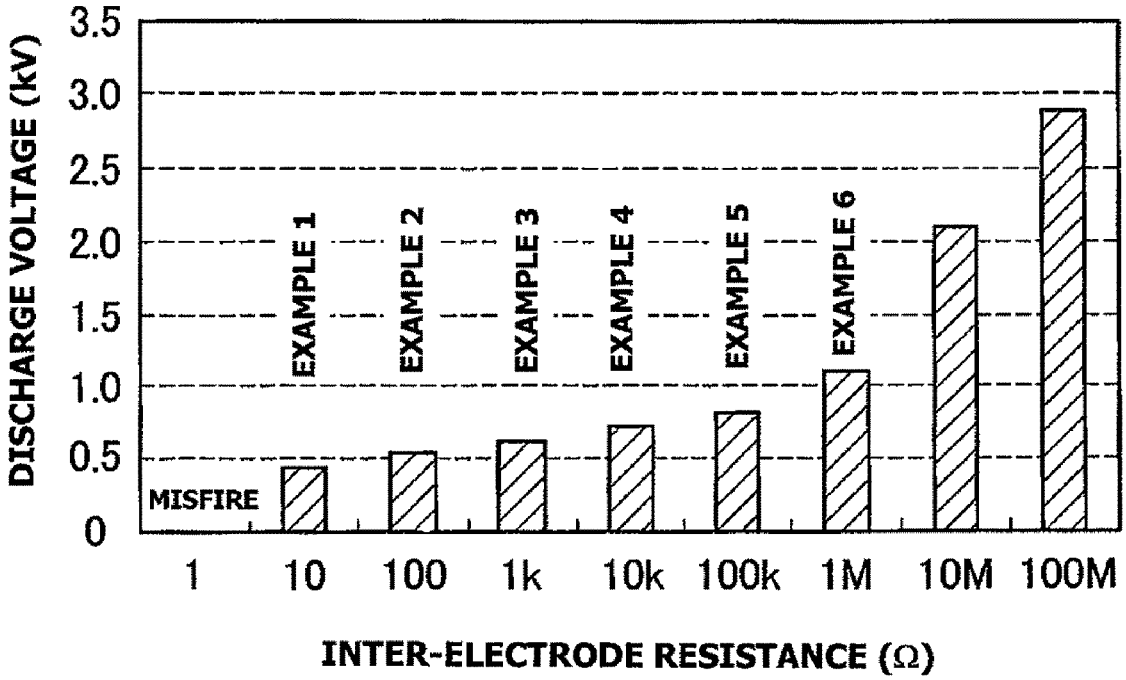
FIG. 9 is a graph showing the results of an evaluation experiment on discharge voltage.

Next, the above-mentioned Examples were experimentally measured for discharge voltage. FIG. 9 shows the results of the experiment. In FIG. 9, the ignition plugs having inter-electrode resistances of 10 MΩ and 100 MΩ, respectively, are conventional ignition plugs which do not have the semiconductor layer 62. The ignition plug having a resistance of 100 MΩ is an almost new plug, whereas the ignition plug having a resistance of 10 MΩ is a plug which has been used to a certain extent. Generally, a plug in which carbon has accumulated between the electrodes as a result of use has a resistance of about 10 MΩ.

As shown in FIG. 9, the discharge voltages of Examples 1 to 6 are about 0.5 kV to 1.2 kV. In the Examples, discharge could be generated with low voltages of about ½ to ⅙ of the discharge voltages (2 kV to 3 kV) of the conventional ignition plugs. That is, through formation of the semiconductor layer 62 between the center electrode 20 and the ground electrode 30 as in the above-described embodiment, an air-fuel mixture can be ignited with voltage lower than that of an ignition plug which does not have the semiconductor layer 62. As a result, the generation of electric noise, which could be generated by application of high voltage, is restrained, i.e., reduced. Further, the occurrence of channeling in the cavity 60 and the orifice 31 is reduced.

In the present experiment, a plug having an inter-electrode resistance of 1Ω was also prepared; however, the plug failed to generate discharge for the following reason. Because of excessively low resistance, despite the employment of the above-mentioned voltage rising rate, power required for spark discharge failed to be supplied.

(C4) Evaluation Experiment on Contact Length

Figure 10:
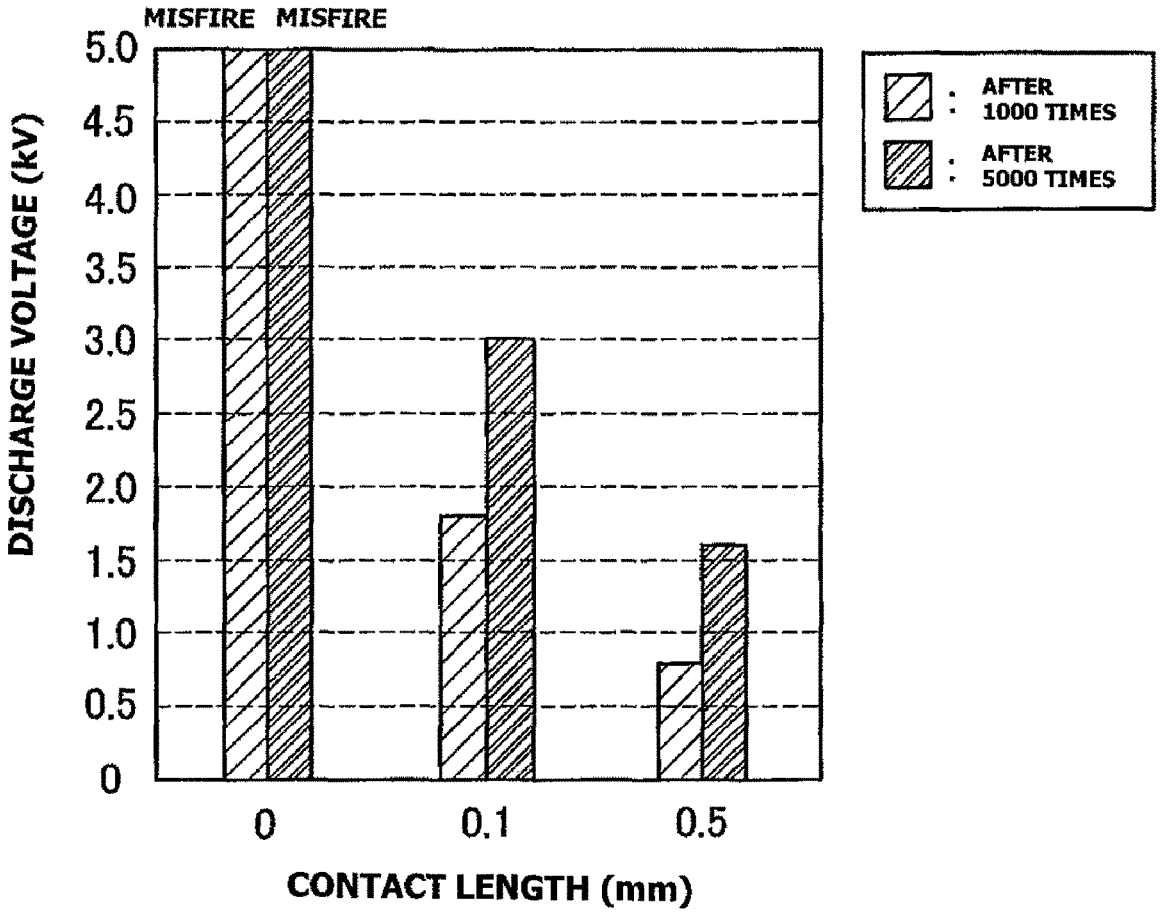
FIG. 10 is a graph showing the results of an evaluation experiment on contact length.

Finally, an evaluation experiment was conducted with respect to the contact length C over which the ground electrode 30 was in contact with the front end surface 16 of the insulator via the semiconductor layer 62. FIG. 10 shows the results of the experiment. The experiment employed three kinds of plasma jet ignition plugs 100. Each plug 100 had a thickness of the ground electrode 30 of 0.5 mm, a diameter of the through-hole 31 of the ground electrode 30 of 1.6 mm, a diameter of the cavity 60 of 1.6 mm, a depth of the cavity 60 from the front end surface 16 of the insulator of 2.0 mm, an outside diameter of the front end surface 16 of the insulator 10 of 5.5 mm, and an inter-electrode resistance of 100Ω. The three plugs 100 had a contact length C of 0 mm, 0.1 mm, and 0.5 mm, respectively. These plasma jet ignition plugs 100 were measured for discharge voltage when discharge was carried out 1,000 times and 5,000 times at an environmental pressure of +0.2 MPa and an environmental temperature of room temperature by use of a power supply whose voltage rising rate is $6.2\times10^{10}$ V/S and whose discharge energy is 1 J. In the present experiment, a contact length C of 0 mm means a state in which the semiconductor layer 62 is formed on the wall of the cavity 60, but the semiconductor layer 62 and the ground electrode 30 are not in contact with each other.

According to the present experiment, in the case of a plug 100 having a contact length C of 0 mm, while the number of discharges was small, discharge could be generated with a voltage of about 5 kV. However, when, after repetition of discharge, the number of discharges reached 1,000 and 5,000, as shown in FIG. 10, discharge failed to be generated, resulting in misfire. By contrast, in the case of a plug 100 having a contact length C of 0.1 mm, after 1,000 discharges, discharge was possible with a voltage of about 1.8 kV, and, after 5,000 discharges, discharge was possible with a voltage of about 3.5 kV. Also, in the case of a plug 100 having a contact length C of 0.5 mm, after 1,000 discharges, discharge was possible with a voltage of about 0.8 kV, and, after 5,000 discharges, discharge was possible with a voltage of about 1.6 kV. That is, it has been confirmed that, when the contact length C is at least 0.1 mm, even after 1,000 and 5,000 discharges, discharge can be generated with a voltage equivalent to or lower than the discharge voltage (2 kV to 3 kV) of a conventional new ignition plug. Also, it has been confirmed that, when the contact length C is at least 0.5 mm, even after 5,000 discharges, discharge can be generated with a voltage lower than the discharge voltage of a conventional new ignition plug. Thus, it has been confirmed from the above-mentioned results of the present experiment that, through employment of a contact length C of at least 0.1 mm, preferably at least 0.5 mm, the spark plug 100 can perform discharge with low voltage, while resistance to deterioration in the cavity 60 and the orifice 31 stemming from a repetition of discharge (particularly, an increase in the diameter of the orifice 31 stemming from channeling) is enhanced.

(C5) State of Jetting of Plasma

Figure 11:
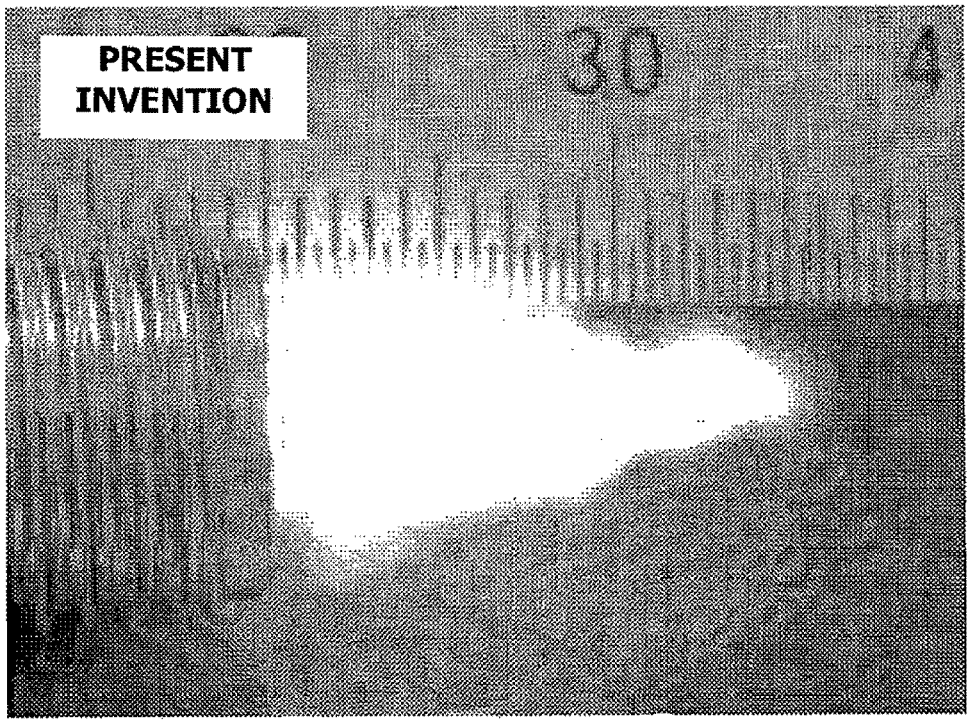
FIG. 11 is a view showing an example of jetting of plasma from the plasma jet ignition plug 100 of the present embodiment.
Figure 12:
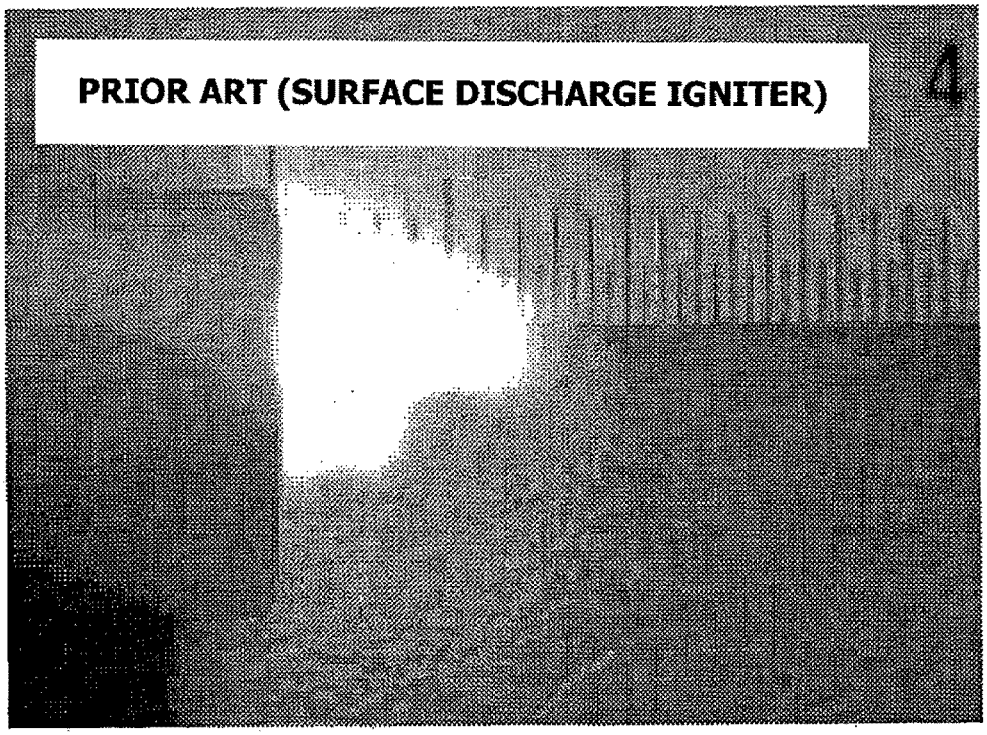
FIG. 12 is a view showing the generation of plasma from a conventional igniter plug of a surface discharge type.

FIG. 11 shows an example of jetting of plasma from the plasma jet ignition plug 100 of the present embodiment. FIG. 12 shows the generation of plasma from a conventional igniter plug of a surface discharge type. As shown in FIG. 11, the plasma jet ignition plug 100 of the present embodiment generated a flame having a length of about 15 mm. By contrast, a flame jetted out from the conventional igniter plug was as short as about 7 mm. That is, the above-mentioned plasma jet ignition plug 100 of the present embodiment can generate a flame greater than that generated by the conventional igniter plug, thereby enhancing ignition of an air-fuel mixture.

While the present invention has been described with reference to the above embodiment and various examples, the present invention is not limited thereto, but may be embodied in various other configurations without departing from the gist of the invention.

Figure 13:
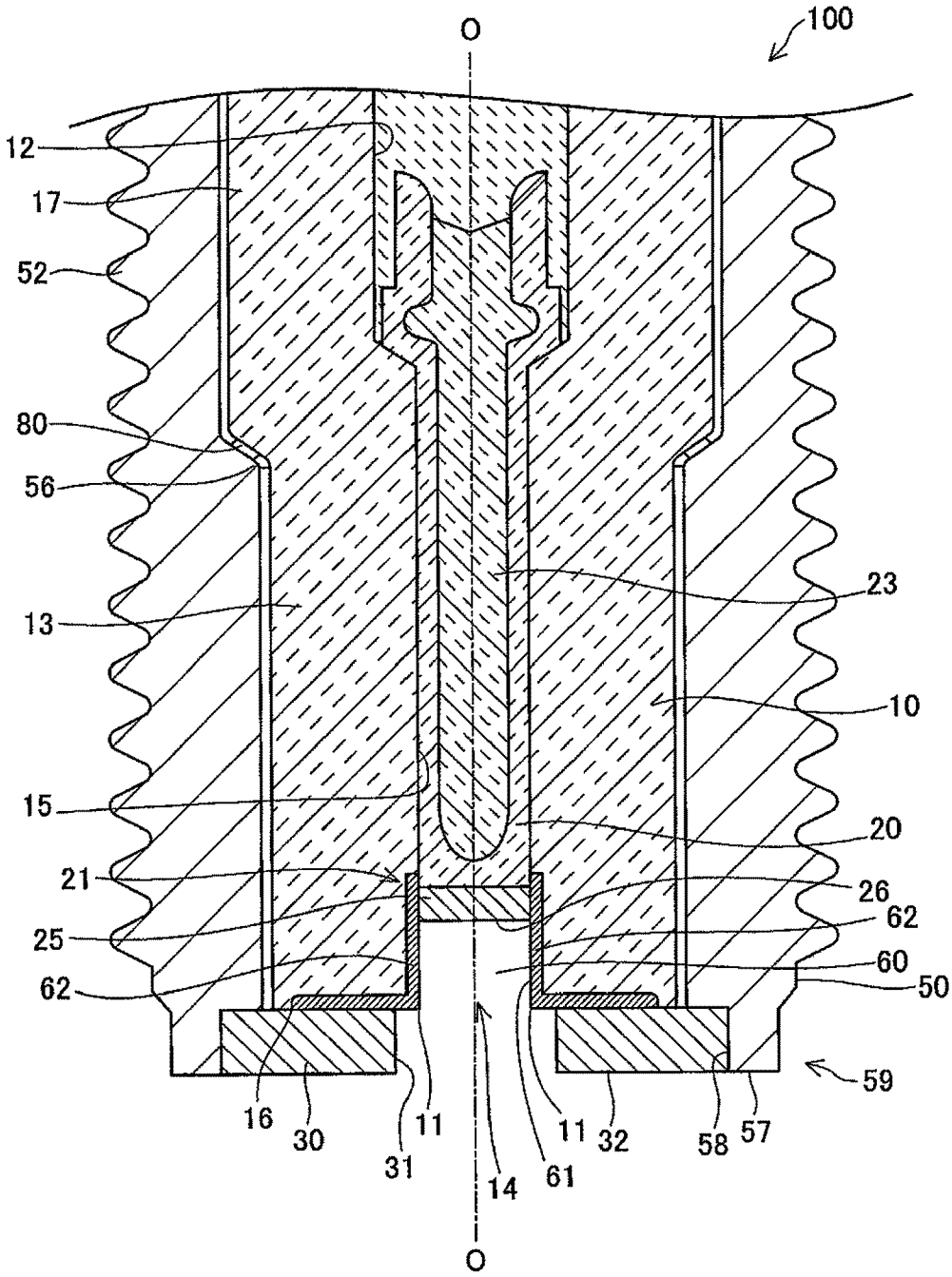
FIG. 13 is a view showing an example in which the semiconductor layer 62 is disposed in such a manner as to be in contact with the side surface of a center electrode 20.

For example, as shown in FIG. 13, the semiconductor layer 62 may be disposed in such a manner as to be in contact with the outer circumferential surface of a front end portion of the center electrode 20. Through employment of this arrangement, even when the center electrode 20 is shortened due to erosion, the contact between the center electrode 20 and the semiconductor layer 62 can be maintained. The above embodiment is described while mentioning the formation of the semiconductor layer 62 on the plasma jet ignition plug 100 for use in an internal combustion engine. However, the semiconductor layer 62 can also be formed in a similar manner on igniter plugs for use in gas engines and gas turbine engines.

Having described the invention, the following is claimed:

1. An ignition plug comprising:

a center electrode;

a substantially tubular insulator having an axial bore extending in a direction of an axis of the center electrode, and holding the center electrode in the axial bore; and a ground electrode disposed in contact with a front end portion of the insulator and having a through-hole;

wherein a front end portion of the center electrode is located rearward of the front end portion of the insulator, a semiconductor layer in contact with the center electrode and the ground electrode, said semiconductor layer being formed along a portion of a surface of the insulator, at least a portion of a surface of the ground electrode is in contact with the front end portion of the insulator via the semiconductor layer, and the portion of the ground electrode which is in contact with the front end portion of the insulator via the semiconductor layer extends at least 0.1 mm radially outward from a circumference of the through-hole.

2. An ignition plug comprising:

a center electrode;

a substantially tubular insulator having an axial bore extending in a direction of an axis of the center electrode, and holding the center electrode in the axial bore; and a ground electrode disposed in contact with a front end portion of the insulator and having a through-hole;

wherein a front end portion of the center electrode is located rearward of the front end portion of the insulator, a semiconductor layer in contact with the center electrode and the ground electrode, said semiconductor layer being formed along a portion of a surface of the insulator, and a rear end portion of the semiconductor layer is in contact with a circumferential portion of a front end surface of the center electrode.

3. An ignition plug according to claim 1 or 2, wherein:

an inter-electrode resistance between the center electrode and the ground electrode is $1\times10^{1}\Omega$ to $1\times10^{6}\Omega$ inclusive.

4. An ignition plug according to claim 1 or 2, wherein:

the semiconductor layer is formed through dispersion of a semiconductor in a portion of the surface of the insulator.

5. An ignition plug according to claim 1 or 2, wherein:

the semiconductor layer is formed by means of sintering a semiconductor a plurality of times into a portion of the surface of the insulator.

6. An ignition plug according to claim 1 or 2, wherein:

the semiconductor layer contains an oxide semiconductor.

7. An ignition plug according to claim 1 or 2, wherein:

the electric conductivity of the semiconductor layer drops from a surface of the semiconductor layer toward an interior of the insulator.

8. An ignition plug according to claim 1 or 2, wherein:

a diameter of the through-hole of the ground electrode is equal to or greater than that of the axial bore of the insulator.

9. An ignition plug according to claim 1 or 2, wherein:

the ignition plug is a plasma jet ignition plug.

10. An ignition system for igniting fuel, comprising:

an ignition plug according to claim 1 or 2, and an ignition device for applying a voltage whose rising rate is $1\times10^{10}$ V/sec or higher to the center electrode or the ground electrode of the ignition plug.

* * * * *